US008740308B2

(12) United States Patent
Leywood et al.

(10) Patent No.: US 8,740,308 B2
(45) Date of Patent: Jun. 3, 2014

(54) COLLAPSIBLE SEAT

(75) Inventors: Nicholas John Leywood, Wagga Wagga (AU); John Edward Smith, Balgowlah Heights (AU); Natarsha Skye Leywood, Wagga Wagga (AU)

(73) Assignee: Box Clever Pty Limited, Balgowlah Heights, NSW (AU)

( * ) Notice: Subject to any disclaimer, the term of this patent is extended or adjusted under 35 U.S.C. 154(b) by 405 days.

(21) Appl. No.: 12/451,029

(22) PCT Filed: Apr. 18, 2008

(86) PCT No.: PCT/AU2008/000542
§ 371 (c)(1),
(2), (4) Date: Apr. 17, 2010

(87) PCT Pub. No.: WO2009/006669
PCT Pub. Date: Jan. 15, 2009

(65) Prior Publication Data

US 2010/0201162 A1 Aug. 12, 2010

(30) Foreign Application Priority Data

Jul. 12, 2007 (AU) ..... 2007903756
Dec. 12, 2007 (AU) ..... 2007906756
Apr. 11, 2008 (AU) ..... 2008901778

(51) Int. Cl.
*A47C 4/00* (2006.01)

(52) U.S. Cl.
USPC ..... 297/440.12

(58) Field of Classification Search
USPC ..... 297/440.12, 440.1, 440.13
See application file for complete search history.

(56) References Cited

U.S. PATENT DOCUMENTS 2,518,955 A * 8/1950 Stelzer ..... 297/440.13
2,940,511 A * 6/1960 Gomes ..... 297/440.12
3,331,634 A * 7/1967 Harrison, Jr. ..... 297/440.12
3,519,307 A * 7/1970 Gittings ..... 297/380
3,606,459 A * 9/1971 Krone ..... 297/440.12
4,385,782 A * 5/1983 Clark, Jr. ..... 297/440.12

(Continued)

FOREIGN PATENT DOCUMENTS

FR 2726447 5/1996
FR 2739536 4/1997

(Continued)

*Primary Examiner* — Milton Nelson, Jr.
(74) *Attorney, Agent, or Firm* — Alston & Bird LLP

(57) ABSTRACT

The invention provides a collapsible seat suitable for forming from a sheet material. The seat includes a seat panel, a back panel linked to the seat panel along a first fold line, and a support panel linked to one side of the back panel via a first web defined by second and third fold lines. The support panel is adapted to be linked to another side of the back panel via a second web partially defined by a fourth fold line. The seat also includes a reinforcement panel having one end linked to the support panel along an eighth fold line and an opposite end. The reinforcement panel is adapted to be positioned generally horizontally and under the seat panel in use. The reinforcement panel includes twelfth and thirteenth fold lines intermediate the seventh fold line and the support panel such that the reinforcement panel is divided into first, second and third portions. The first and third portions are substantially identical in size.

21 Claims, 10 Drawing Sheets

(56) References Cited

U.S. PATENT DOCUMENTS

| | | | | | |
|---|---|---|---|---|---|
| 4,556,253 | A | * | 12/1985 | Geneve et al. | 297/440.12 |
| 4,877,292 | A | | 10/1989 | Volpe et al. | |
| 5,020,854 | A | | 6/1991 | Powell | |
| 5,860,704 | A | * | 1/1999 | Smith | 297/440.12 |
| 6,048,032 | A | * | 4/2000 | Stewart | 297/440.12 |
| 2004/0056526 | A1 | * | 3/2004 | Willy | 297/440.13 |

FOREIGN PATENT DOCUMENTS

| | | |
|---|---|---|
| FR | 2764492 | 12/1998 |
| WO | WO 91/001664 | 2/1991 |
| WO | WO 97/028722 | 8/1997 |
| WO | WO 02/39851 | 5/2002 |
| WO | WO 2005/020759 | 3/2005 |
| WO | WO 2007/129904 | 11/2007 |

* cited by examiner

COLLAPSIBLE SEAT

TECHNICAL FIELD

The present invention relates broadly to a collapsible seat and particularly although not necessarily exclusively relates to a collapsible seat formed from a sheet material.

BACKGROUND ART

Collapsible furniture of known types generally have the deficiencies of being complex and bulky and hence difficult to erect and cumbersome to carry.

Previous attempts have been made to simplify the construction of collapsible seats or chairs. For instance, the specification of French patent application No. 2764492 discloses a seat made out of cardboard having only four connected panels.

The seat of FR 2764492 is however believed to suffer from at least a shortcoming of having a low level of integrity and sustainability.

The present invention aims to overcome or ameliorate such deficiencies and shortcomings encountered with prior art collapsible seats.

SUMMARY OF THE INVENTION

According to one aspect of the present invention there is provided a collapsible seat suitable for forming from a sheet material, the seat including:

- a seat panel;
- a back panel linked to the seat panel along a first fold line;
- a support panel linked to one side of the back panel via a first web defined by second and third fold lines, and adapted to be linked to another side of the back panel via a second web partially defined by a fourth fold line;
- a reinforcement panel linked to the support panel along a fifth fold line, the reinforcement panel adapted to be positioned generally horizontally and under the seat panel in use;
- each of the first and second webs has an extension linking the respective webs with at least part of the reinforcement panel;
- wherein in use the back panel is adapted to be positioned generally vertically, the seat panel is adapted to be positioned generally horizontally and on one side of the back panel and the support panel is adapted to be positioned generally vertically and on the other side of the back panel.

The first web may further include a sixth fold line dividing the first web into two portions foldable towards each other. In this embodiment, the second and third fold lines are disposed at an acute angle to each other, both meeting the sixth fold line.

The second web is preferably linked to a first joining means along a seventh fold line, the joining means being adapted to be in registry with at least part of the back panel in use. Preferably the first joining means is connected to at least part of the back panel in use. More preferably the joining means is adhered to the back panel. Even more preferably the joining means is a tab.

The second web is preferred to include an eighth fold line dividing the second web into two portions foldable towards each other. The fourth and seventh fold lines are preferred to be disposed at the same acute angle to each other, both meeting the eighth fold line.

The reinforcement panel may be linked to a second joining means along a ninth fold line, the second joining means adapted to be in registry with the seat panel in use. Preferably the second joining means is adhered to the seat panel in use. More preferably the second joining means or the reinforcement panel includes a tenth fold line, so positioned that the distance between the ninth and tenth fold lines corresponds to a thickness of the sheet material thereby enhancing the foldability of the seat panel when the second joining means is adhered thereon.

The reinforcement panel is preferred to further include an eleventh fold line dividing the reinforcement panel into two portions foldable towards each other, the eleventh fold line being so positioned as to correspond to the sixth and the eighth fold lines.

The support panel may include a crease adapted when in use to conform to a contour of a back of a human body. The crease is preferred to be curved extending from one side of the support panel to another. The crease when in use can function to enable the support panel to optimise its coverage of and supporting capability to the back of the human body via the back panel.

Preferably, the collapsible sheet is suitable for forming from a low cost sheet material such as cardboard. However, other types of sheet material may also be suitable for the collapsible seat of the invention and are within its scope.

The fold lines are preferred to be formed by scoring or creasing, but other suitable methods may be applicable.

The seat panel is linked to the back panel along the first fold line and use is made of this to position the seat panel with respect to the back panel, so that the seat panel is generally horizontal in use relative to the back panel, which is generally vertical in use. In this way, the seat panel may be positioned to echo the terrain in which the seat is placed—for example, flat (substantially horizontal) or sloping (a little inclined to the horizontal) orientations. The term "generally horizontal" is intended to encompass these orientations.

The back panel may be substantially vertical, but preferably it is inclined to the vertical by about 5° so that the back panel tilts back a little in use to allow a comfortable seating position. The term "generally vertical" is intended to mean that the orientation is upright, as opposed to the seat panel.

In the present embodiment, each of the seat, back and support panels includes a cut-out. The cut-outs are preferred to be adapted to correspond to one another when the seat is collapsed to form a carry handle.

According to another aspect of the present invention there is provided a blank for the collapsible seat of the invention, the blank including:

- a seat panel;
- a back panel linked to the seat panel along a first fold line; and
- a support panel linked to the back panel along a second fold line, the support panel being adapted to be linked to one side of the back panel via the first web having a third fold line, and adapted to be linked to an opposing side of the back panel via the second web having a fourth fold line;
- a reinforcement panel having one end linked to the support panel along a fifth fold line and an opposite end, the reinforcement panel being adapted to be positioned generally horizontally and under the seat panel in use;
- wherein each of the first and second webs has an extension linking the respective webs with at least part of the reinforcement panel;

The first web is preferably linked to a first joining means along a sixth fold line, the first joining means adapted to be in registry with at least part of the back panel in use. Preferably the first joining means is connected to at least part of the back panel in use.

The second web is preferably linked to a second joining means along a seventh fold line, the second joining means adapted to be in registry with at least part of the back panel in use. Preferably the second joining means is connected to at least part of the back panel in use. It is preferred that part of the reinforcement panel is connected to at least part of the seat panel.

Each of the first and second webs is preferred to include an additional fold line dividing each of the first and second webs into two portions foldable towards each other.

The reinforcement panel may include eighth and ninth fold lines intermediate the fifth fold line and the opposite end. Preferably the eighth and ninth fold lines are located such that the reinforcement panel is divided into first, second and third portions, the first and third portions being substantially identical in size.

The third portion may have one or more apertures or cutouts adapted to in use receive one or more objects.

When the collapsible seat is in a collapsed position with the back and support panels on one side and abutting the seat panel, folding of the first portion towards the support panel may result in a cavity defined by the first, second and third portions, bulging from an opposite side of the seat panel.

The cavity is adapted to hold the one or more objects received by the third portion.

The objects may include beverage bottles, glasses, books, towels, DVDs, cameras and toys.

Each extension preferably has a further fold line dividing the extension into two halves foldable towards one another. More preferably each extension is in the shape of a quarter of a circle.

According to a further aspect of the present invention there is provided a collapsible seat suitable for forming from a sheet material, the seat including:

a seat panel;

a back panel linked to the seat panel along a first fold line;

a support panel linked to one side of the back panel via a first web defined by second and third fold lines, and adapted to be linked to another side of the back panel via a second web partially defined by a fourth fold line;

a reinforcement panel having one end linked to the support panel along a fifth fold line and an opposite end, the reinforcement panel adapted to be positioned generally horizontally and under the seat panel in use;

wherein the reinforcement panel includes sixth and seventh fold lines intermediate the fifth fold line and the opposite end such that the reinforcement panel is divided into first, second and third portions, the first and third portions being substantially identical in size, According to a yet further aspect of the present invention there is provided a blank for forming of a collapsible seat, the blank including:

a seat panel;

a back panel linked to the seat panel along a first fold line;

a support panel linked to the back panel along a second fold line;

a reinforcement panel having one end linked to the support panel along a third fold line and an opposite end, the reinforcement panel adapted to be positioned generally horizontally and under the seat panel in use;

wherein the reinforcement panel includes fourth and fifth fold lines intermediate the third fold line and the opposite end such that the reinforcement panel is divided into first, second and third portions, the first and third portions being substantially identical in size.

According to a yet further aspect of the present invention there is provided a method of constructing the collapsible seat of the invention from the blank of the invention, the method including the steps of:

(a) positioning the back panel generally vertically;

(b) folding the seat panel away from the back panel until the seat panel is generally horizontal and on one side of the back panel;

(c) folding the support panel towards the back panel until the support panel is superimposed on the other side of the back panel;

(d) folding the first and second joining means towards the back panel;

(e) connecting the first and second joining means to the back panel; and (f) pushing the first and second webs towards each other by applying pressure on the fold lines thereon;

(g) folding the reinforcement panel towards an underside of the seat panel;

(h) connecting the second joining means to the underside of the seat panel; and (i) pushing each extension towards an interior of the seat by applying pressure on the further fold line.

The connection mentioned above may be effected by means of an adhesive.

The method may include a yet further step of:

(j) closing a gap between the reinforcement panel, and the first and second webs, by applying pressure on the eleventh fold line.

When the collapsible seat of the present invention includes the embodiment as described above having the reinforcement panel with the first, second and third portions, the method may include yet further steps of:

(k) collapsing the collapsible seat such that the back and support panels are on one side and abutting the seat panel; and (l) folding the first portion towards the support panel resulting in a cavity defined by the first, second and third portions, bulging from an opposite side of the seat panel.

Subsequently, one or more objects may be received by the third portion and held in place within the cavity.

According to a further aspect of the present invention there is provided a sheet detachably mountable onto the collapsible seat described above, the sheet having a tab and two tags adapted to engage the handle and the cavity of the collapsible seat respectively.

BRIEF DESCRIPTION OF THE DRAWINGS

In order to achieve a better understanding of the nature of the present invention preferred embodiments of a collapsible seat will now be described, by way of example only, with reference to the accompanying drawings in which.

DETAILED DESCRIPTION OF THE INVENTION

Example 1

Figure 1:
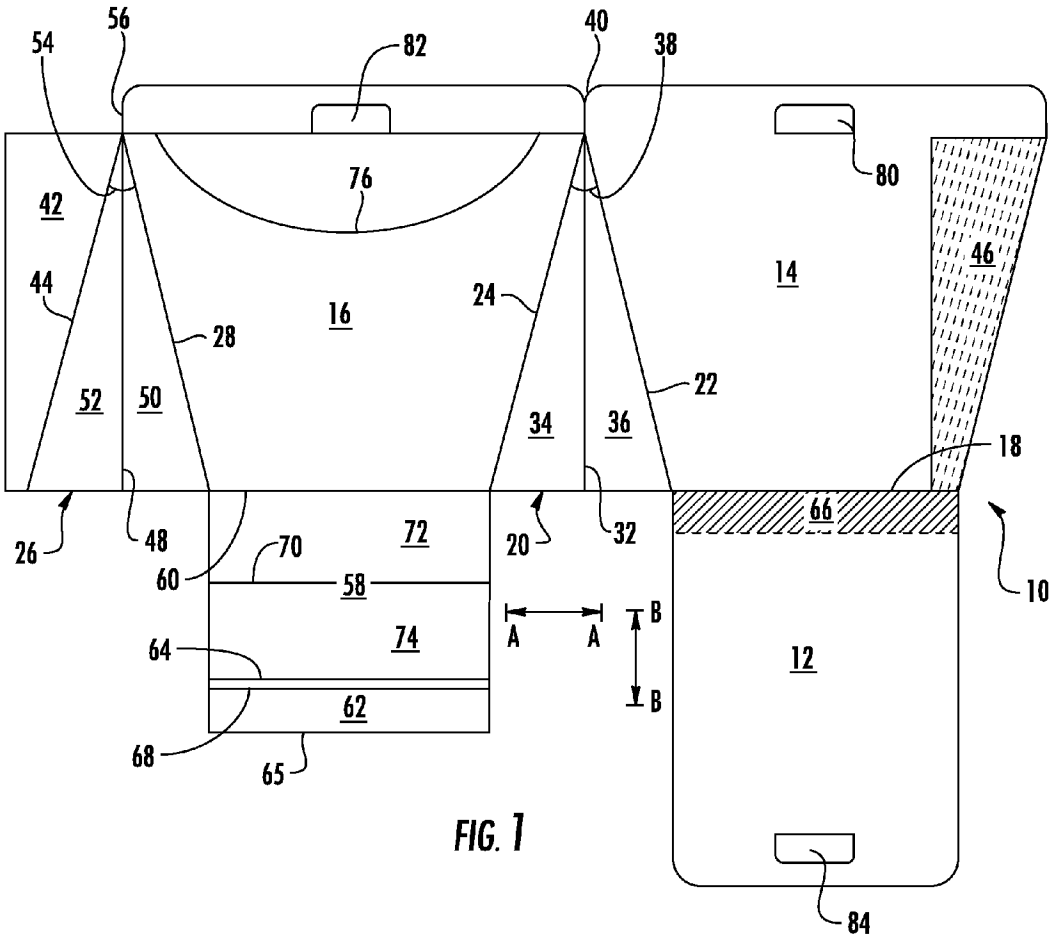
FIG. 1 is a plan view of a blank for a collapsible seat to assist in illustrate in connection with the present invention.

As shown in FIG. 1, there is a blank 10 for a collapsible seat including a seat panel 12, a back panel 14, and a support panel 16. The back panel 14 is linked to the seat panel 12 along a first fold line 18. The support panel 16 is linked to one side of the back panel 14 via a first web 20 defined by fold lines 22 and 24. The support panel 16 is adapted to be linked to another side of the back panel 14 via a second web 26 partially defined by a fold line 28. The back and support panels 14 and 16 are adapted to be juxtaposed in one direction indicated by an arrow denoted A-A, so that the support panel 16 is located behind the back panel 14 in use. The seat panel 12 is orientated in another direction indicated by an arrow denoted B-B. The directions represented by the arrows A-A and B-B in the present embodiment are substantially perpendicular to each other.

Figure 2:
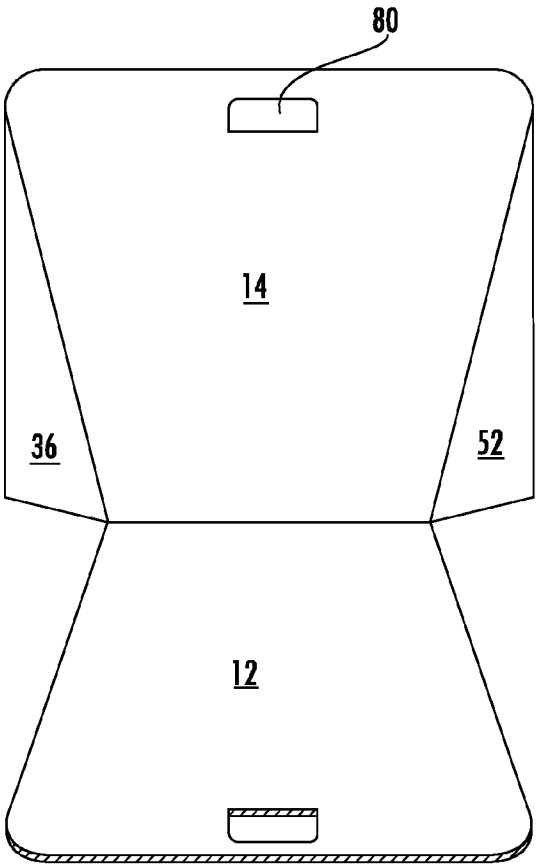
FIG. 2 is a perspective view from above showing the collapsible seat in an erected state.

Referring to FIG. 2, it may be observed that the blank 10, in the present embodiment in the form of a sheet material, is used to form a collapsible seat 30. As best shown in an erected state in FIGS. 2 and 3, the back panel 14 is adapted to be positioned generally vertically whilst the seat panel 12 is adapted to be positioned generally horizontally and on one side of the back panel 14. The support panel 16 is adapted to be positioned generally vertically and on the other side of the back panel 14.

Turning back to FIG. 1, the first web 20 includes a fold line 32 dividing the first web 20 into two portions 34 and 36 foldable towards each other. The fold lines 22 and 24 are disposed at an acute angle 38 to each other, both meeting the fold line 32 at a point 40.

The second web 26 is linked to a joining means 42 along a fold line 44. The joining means 42 is adapted to be in registry with at least part of the back panel 14 when in use.

In the present embodiment, the joining means 42 when in use is connected to part of the inward-facing side of the back panel 14 (represented by the shaded area 46). Joining means 42 may be tucked into position, but may be secured by one or more staples, adhesive or other suitable means.

The second web 26 includes a fold line 48 dividing the second web 26 into two portions 50 and 52 foldable towards each other. The fold lines 28 and 44 are preferred to be disposed at an acute angle 54 to each other, both meeting the fold line 48 at a point 56. Preferably, angle 54 is the same as angle 38.

The blank 10 or collapsible seat includes a reinforcement panel 58 at one end linked to the support panel 16 along a fold line 60 and an opposite end 65. The reinforcement panel 58 is adapted to be positioned generally horizontally and under the seat panel 12. The reinforcement panel 58 is linked to a second joining means 62 along a fold line (64, 68). The second joining means 62, in the present embodiment is in the form of a tab, adapted to be in registry with the seat panel 12. In the erected state, the joining means 62 is connected to a portion of the underside of the seat panel 12 (represented by the shaded area 66) by an adhesive.

The second joining means 62 is separated from reinforcement panel 58 by fold lines 64 and 68. The fold line 68 is so positioned that the distance between the fold lines 64 and 68 corresponds to the thickness of the blank 10 (ie. sheet material). The provision of the distance between the fold lines 64 and 68 enhances the foldability of the seat panel 12 when the joining means 62 is adhered thereon.

The reinforcement panel 58 includes a fold line 70 which divides the reinforcement panel 58 into two portions 72 and 74 foldable towards each other. The fold line 70 is so positioned as to correspond to the fold lines 32 and 48 of the webs 20 and 26, respectively.

Figure 4:
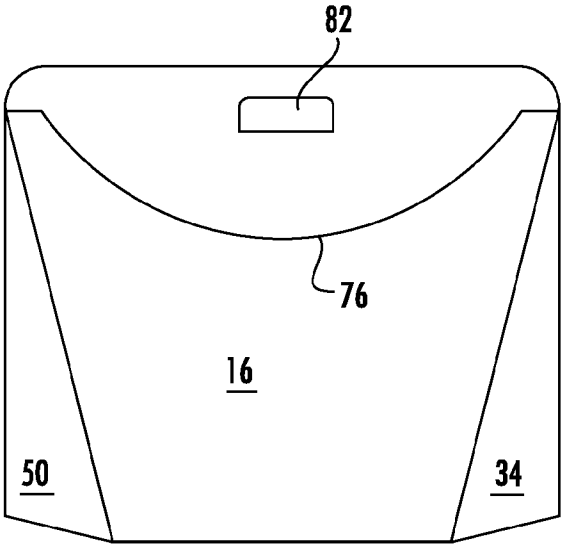
FIG. 4 is a back view of the collapsible seat of FIG. 2.

Referring to FIGS. 1 and 4, it may be observed that the support panel 16 includes a crease 76. The crease 76 is adapted to conform to a contour of the back of a human body. The crease 76 in this embodiment is curved extending from one side of the support panel 16 to another. The crease 76 functions to enable the support panel 16 to optimise its coverage of and supporting capability to the back of the human body via the back panel 14.

Figure 5:
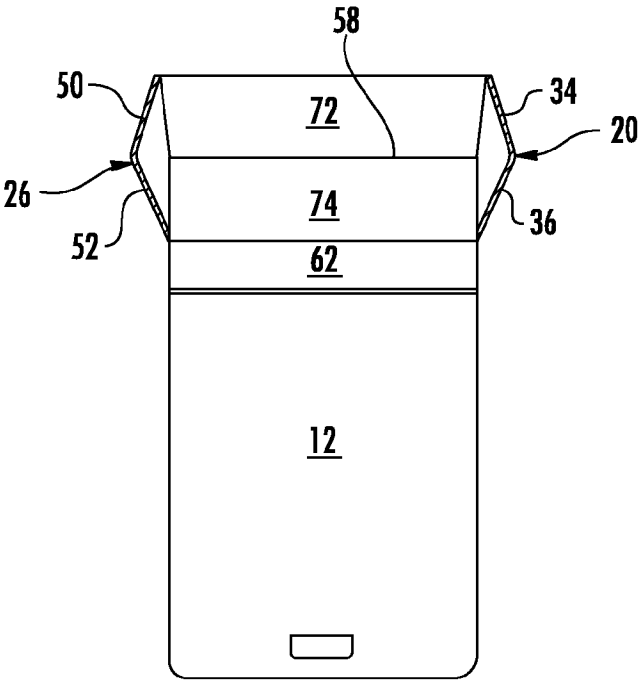
FIG. 5 is a bottom view of the collapsible seat of FIG. 2.

Referring now to FIG. 5, it may be seen that the second joining means 62 is in registry with and adhered to the underside of the seat panel 12 when the collapsible seat is in the erected state.

It should be noted that the collapsible seat of the present invention is suitable for forming from a low cost sheet material such as cardboard. However, other types of sheet material may also be suitable for the seat of the invention and are within it scope.

All of the fold lines 18, 22, 24, 28, 32, 44, 48, 60, 64, 68 and 70 are formed by scoring or creasing, but other suitable methods may be applicable.

Figure 3:
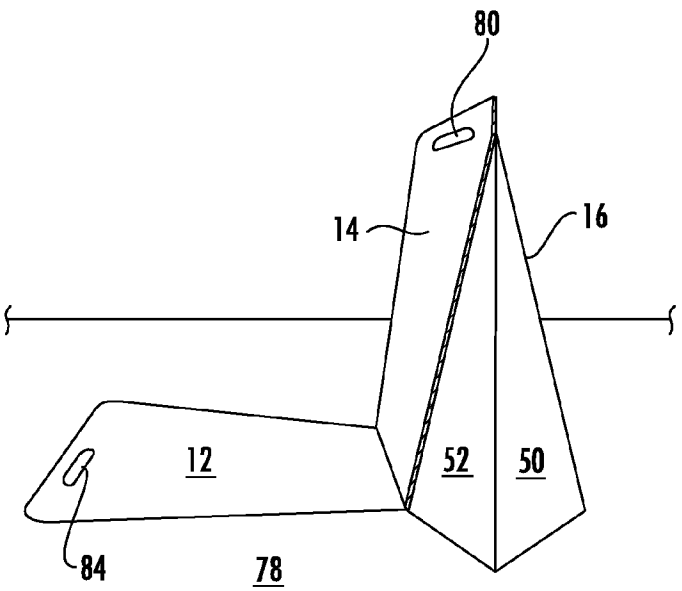
FIG. 3 is a perspective view from the side showing the collapsible seat of FIG. 2.

It will be appreciated that the seat panel 12 is linked to the back panel 14 along the fold line 18 and use is made of this to position the seat panel 12 with respect to the back panel 14. As such, the seat panel 12 is generally horizontal in use relative to the back panel 14, which is generally vertical in use. In this way, the seat panel 12 may be positioned to echo the terrain (as shown in FIGS. 2 and 3) on which the collapsible seat is placed—for example, flat (substantially horizontal) or sloping (a little inclined to the horizontal) orientations. It should be noted that the term "generally horizontal" for the purposes of this specification is intended to encompass these orientations.

As best shown in FIG. 3, the back panel 14 may be substantially vertical. It is however preferred to be inclined to the vertical by about 5° so that the back panel 14 tilts back a little in use to allow a comfortable seating position. It is emphasised that the term "generally vertical" is intended to mean that the orientation is upright, as opposed to the seat panel 12 and not that it is strictly vertical.

Referring back to FIG. 1, each of the seat, back and support panels 12, 14 and 16 includes a cut-out 80, 82 and 84. The cut-outs 80, 82 and 84 are preferred to be adapted to correspond to one another when the collapsible seat is in a collapsed state, to provide a handle for transporting the seat.

Referring to FIG. 5, to collapse the collapsible seat, the back and support panels 14 and 16 are pushed towards each other so that the webs 20 and 26 bulge outwardly. The seat panel 12 is then folded towards the support panel 16 until they make contact with each other. In this orientation, the cut-outs 80, 82 and 84 are in communication with each other.

A method of constructing the collapsible seat from a sheet material will now be described. The general steps involved in the method of construction are as follows: [0099] (a) position the back panel 14 generally vertically; [0100] (b) fold the seat panel 12 around fold line 18 away from the back panel 14 until the seat panel 12 is generally horizontal and on one side of the back panel 14; [0101] (c) fold the support panel 16 around fold line 32 towards the back panel 14 until the support panel 16 is superimposed on the other side of the back panel 14; [0102] (d) fold the first joining means 42 around fold line 48 towards the back panel 14; [0103] (e) connect the first joining means 42 to the back panel 14; and [0104] (f) push the first and second webs 20 and 26 towards each other by applying pressure on the fold lines 32 and 48.

In the present embodiment, the method also includes the further steps of:

(g) folding the reinforcement panel 58 around fold line 60 towards an underside of the seat panel 12; and (h) folding the second joining means 62 around fold lines 64/68 and adhering to the underside of the seat panel 12.

The method may include a yet further step of folding the two portions 72 and 74 of the reinforcement panel 58 towards each other by applying pressure on the fold line 70. This enables the reinforcement panel 58 to correspond to and co-operate with the webs 20 and 26 thereby enhancing the sustainability and integrity of the collapsible seat.

Example 2

Figure 6:
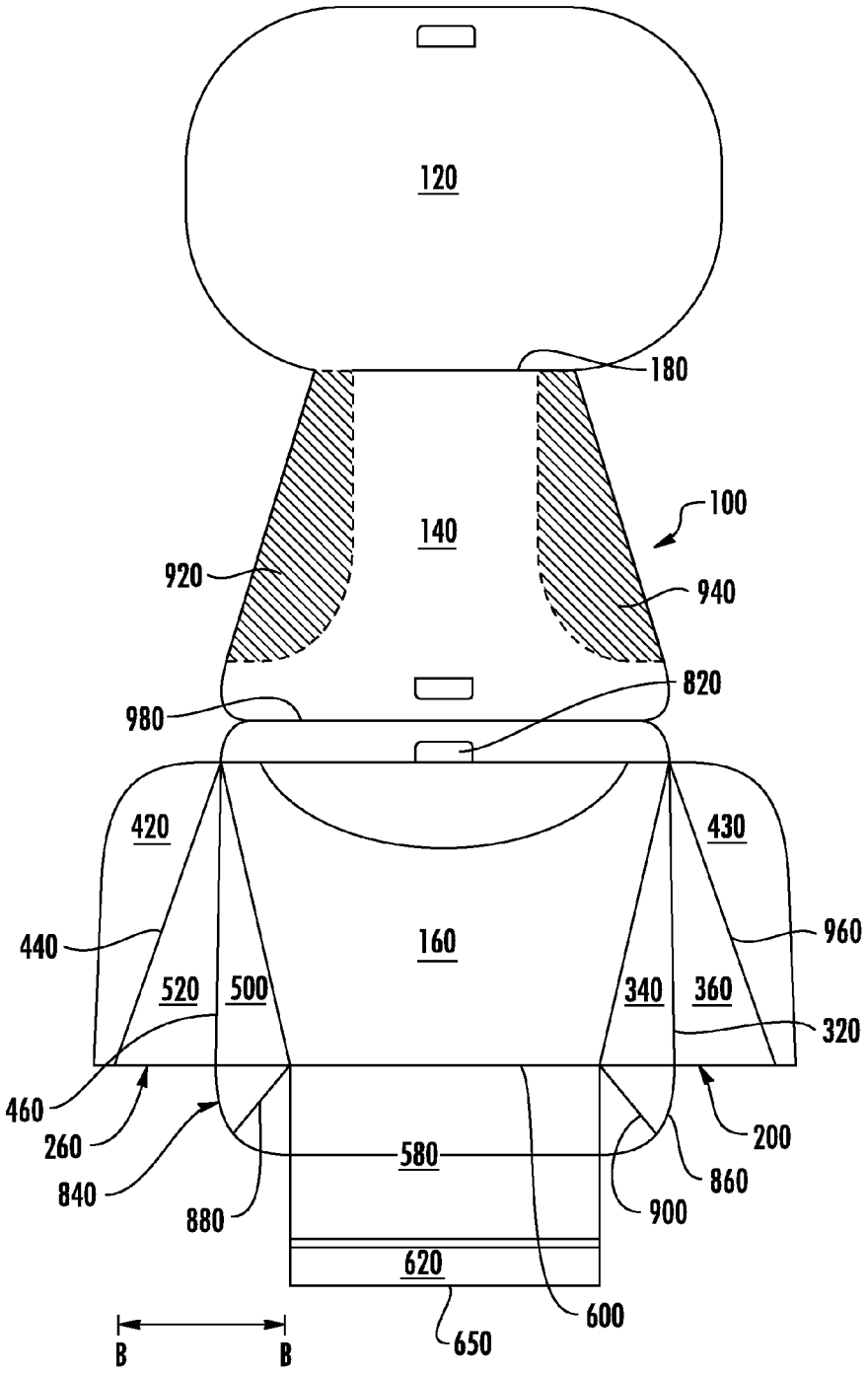
FIG. 6 is a plan view of a blank for a collapsible seat in accordance with one embodiment of the present invention.
Figure 7:
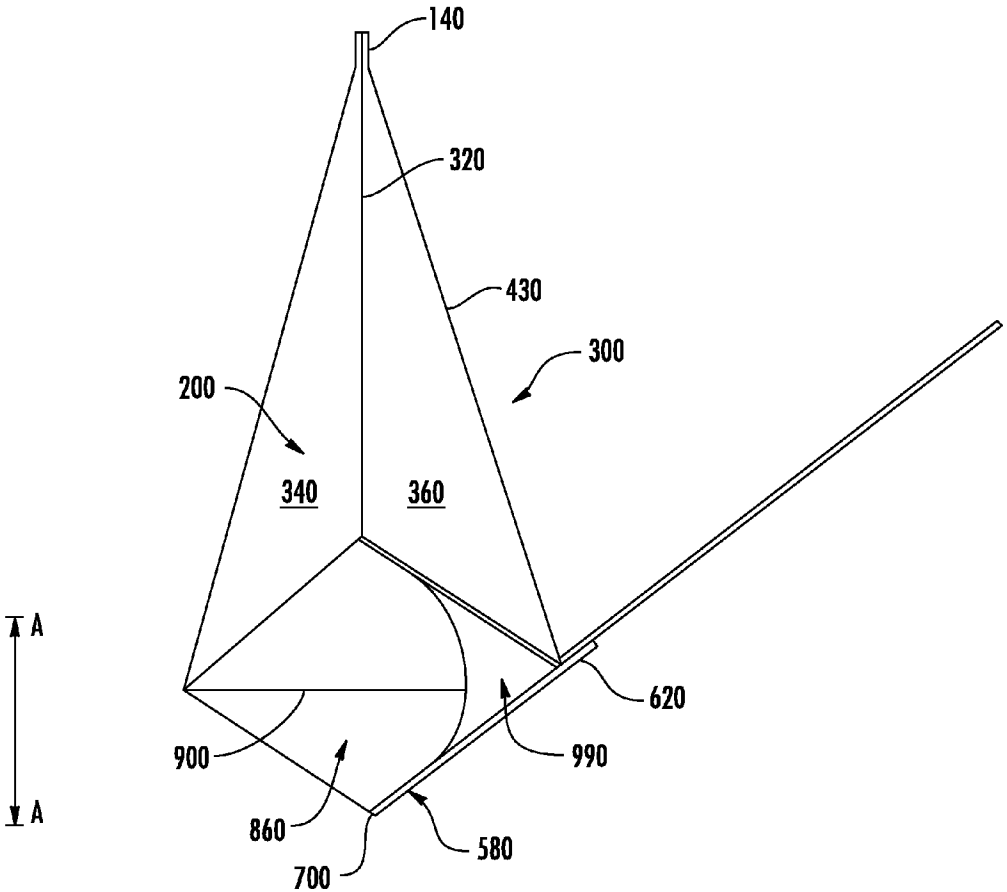
FIG. 7 is a perspective view from the side showing the collapsible seat of FIG. 6.

As shown in FIGS. 6 and 7, there is another embodiment of a blank 100 and collapsible seat 300 respectively. For ease of reference, like "componentry" of the blank 100 as compared to the seat 10 has been designated with an additional "0", for example the cut-out of the seat 100 is 820. The blanks and seats are similar in construction and configuration except for the following.

The blank 100 includes a support panel 160 adapted to be linked to one side of a back panel 140 via a first web 260 having a fold line 480. The support panel 160 is also adapted to be linked to an opposing side of the back panel via a second web 200 having a fold line 320.

The first web 260 is linked to a (first) joining means 420 along a fold line 440. The (first) joining means 420 is adapted to be in registry with a shaded part 920 of the back panel 140 in use. The (first) joining means 420 is connected to the shaded part 920 of the back panel 140 by an adhesive such as a glue in use. The second web 200 is linked to a (second) joining means 430 along a fold line 960. The (second) joining means 430 is adapted to be in registry with a shaded part 940 of the back panel 140 in use. In this embodiment, the (second) joining means is connected to the shaded part 940 of the back panel 140 by an adhesive.

The first and second webs 260 and 200 include additional fold lines 480 and 320 respectively. Each fold line 480 and 320 divides each of the webs 880 or 860 into two portions 520 & 500, 340 & 360 foldable towards each other.

Each of the first and second webs 260 and 200 has an extension 840 and 860 linking the respective webs with a part of the reinforcement panel 580. Each extension 840 or 860 has a fold line 880 or 900 dividing the extension 840 or 860 into two halves foldable towards one another. The extensions 840 and 860 are in the shape of a quarter of a circle. (It will be appreciated by one skilled in the art that equivalent extensions may be included in the embodiment in FIGS. 1 to 5).

In this embodiment, the reinforcement panel 580 is linked at one end to the support panel 160 along a folded line 600. The reinforcement panel has an opposite end 650. The reinforcement panel 580 is adapted to be positioned generally horizontally and under the seat panel 120 in use. In an erected state, a joining means 620 is connected to portion of the underside of the seat panel 120 by an adhesive.

It should also be noted that the support panel 160 in this embodiment is linked to the back panel 140 along a fold line 980. Referring now to FIG. 7, in use, the joining means 420 and 430 are adhered on to the back panel 140. Each extension 840 and 860 is pushed towards an interior 990 of the seat 300 by applying pressure on the respective fold lines 880 and 990. As a result, the reinforcement panel 580 is flattened to abut the surface on which the seat 300 is to be placed. To this end, pressure may be applied on the fold line 700 to close a gap denoted by A-A between the reinforcement panel 580 and the first and second webs 200 & 260.

Various fold lines in Examples 1 and 2 correspond as follows:

| Fold lines | Example 1 | Example 2 |
|---|---|---|
| 1th | 18 | 180 |
| 2rd | 22 | 980 |
| 3rd | 24 | 480 |
| 4th | 28 | 320 |
| 5th | 60 | 600 |
| 6th | 32 | 440 |
| 7th | 44 | 960 |
| 8th | 48 | |
| 9th | 64 | |
| 10th | 68 | |
| 11th | 70 | |

Example 3

Figure 8:
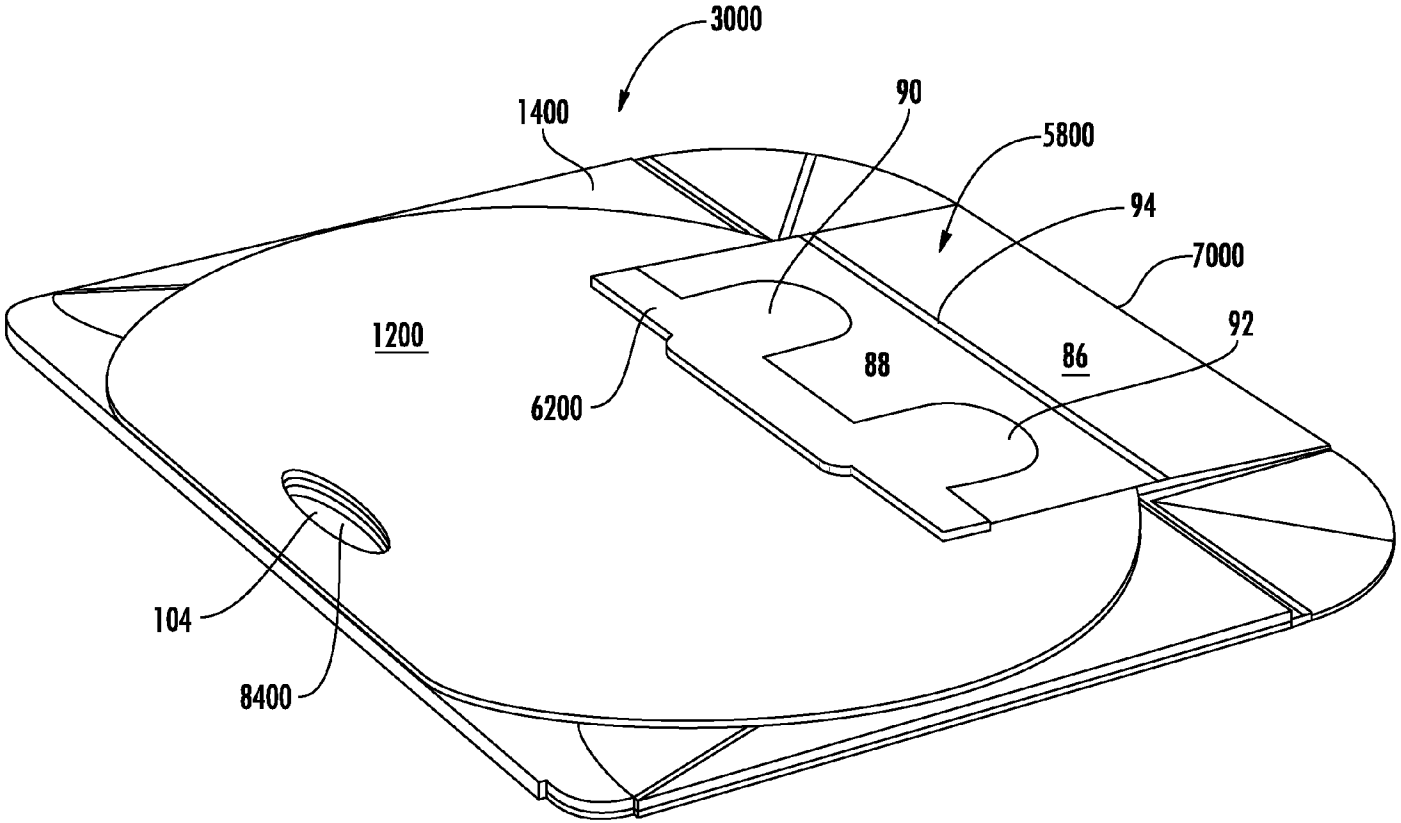
FIG. 8 is a perspective view of a collapsible seat in accordance with another embodiment of the present invention in a collapsed position, showing an reinforcement panel in a folded position.

Referring to FIG. 8, a further embodiment of the collapsible seat 3000 adapted to be formed by a blank similar to that described above is shown. For ease of reference, like "componentry" of the seat 3000 as compared to the seats illustrated in other drawings has been designated with an additional "00", for example the cut-out of the seat 3000 is 8200. The seat 3000 the seats illustrated in other drawings are similar in construction and configuration except for the following.

The reinforcement panel has one end linked to the support panel along fold line 6000 and an opposite end 6500. The reinforcement panel 6200 also has fold lines 7000 & 94 intermediate the fold line 6000 and the opposite end 6500 (see FIG. 11). The fold lines 7000 and 94 are located such that the reinforcement panel 6200 is divided into first, second and third portions 84, 86 & 88. The first and third portions 84 & 88 are substantially identical in size.

Figure 9:
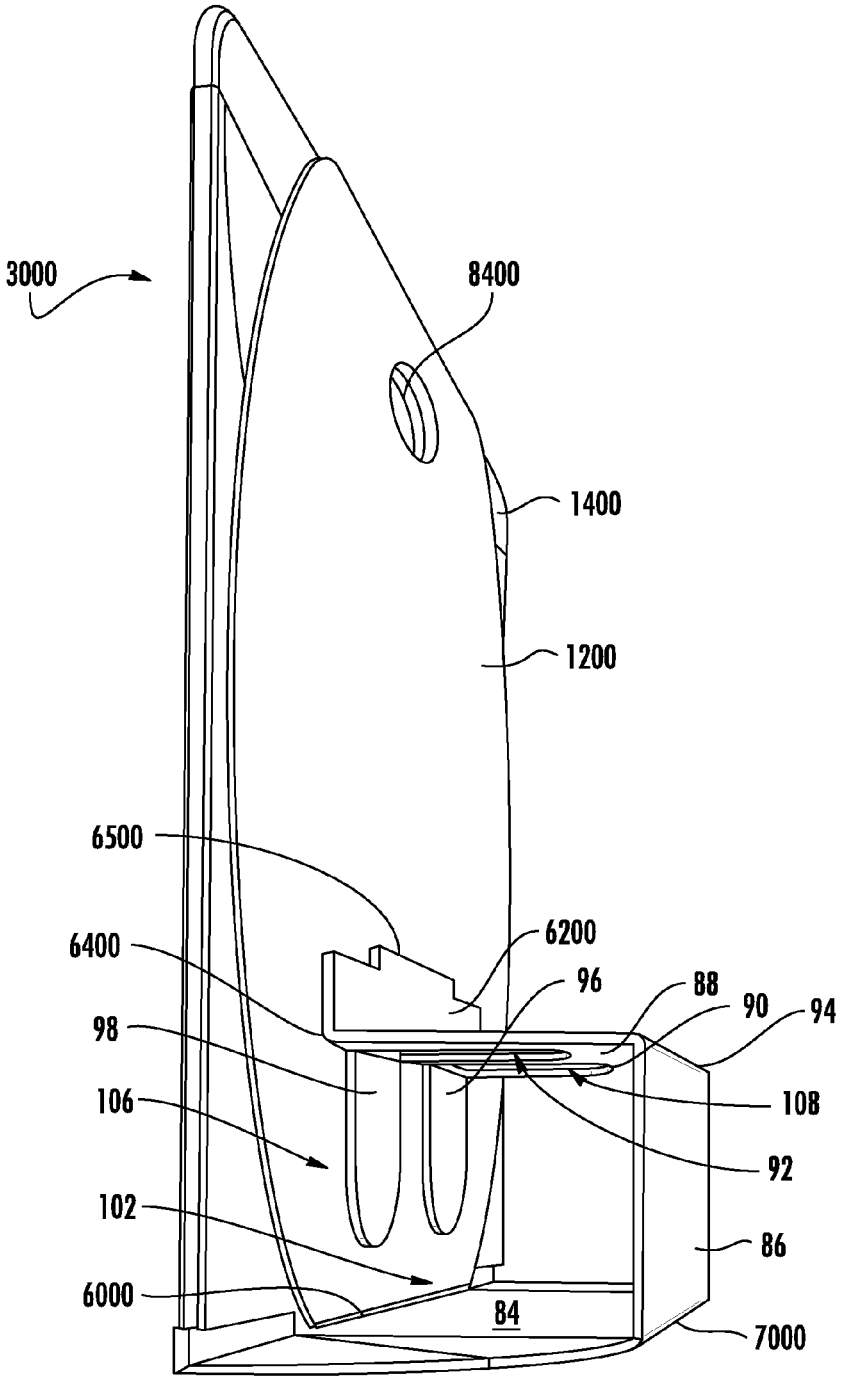
FIGS. 9 and 10 are perspective views of the collapsible seat of FIG. 8 showing the reinforcement panel in an extended position.
Figure 10:
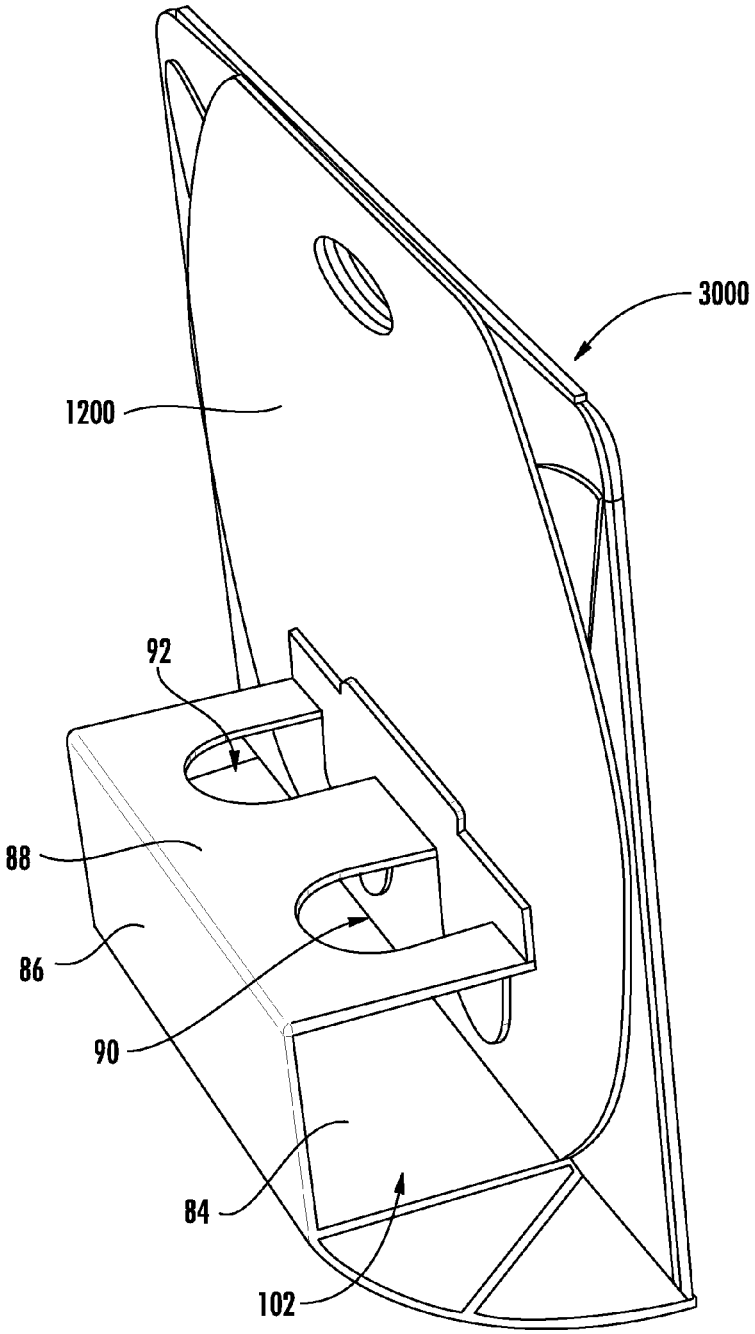
Figure 11:
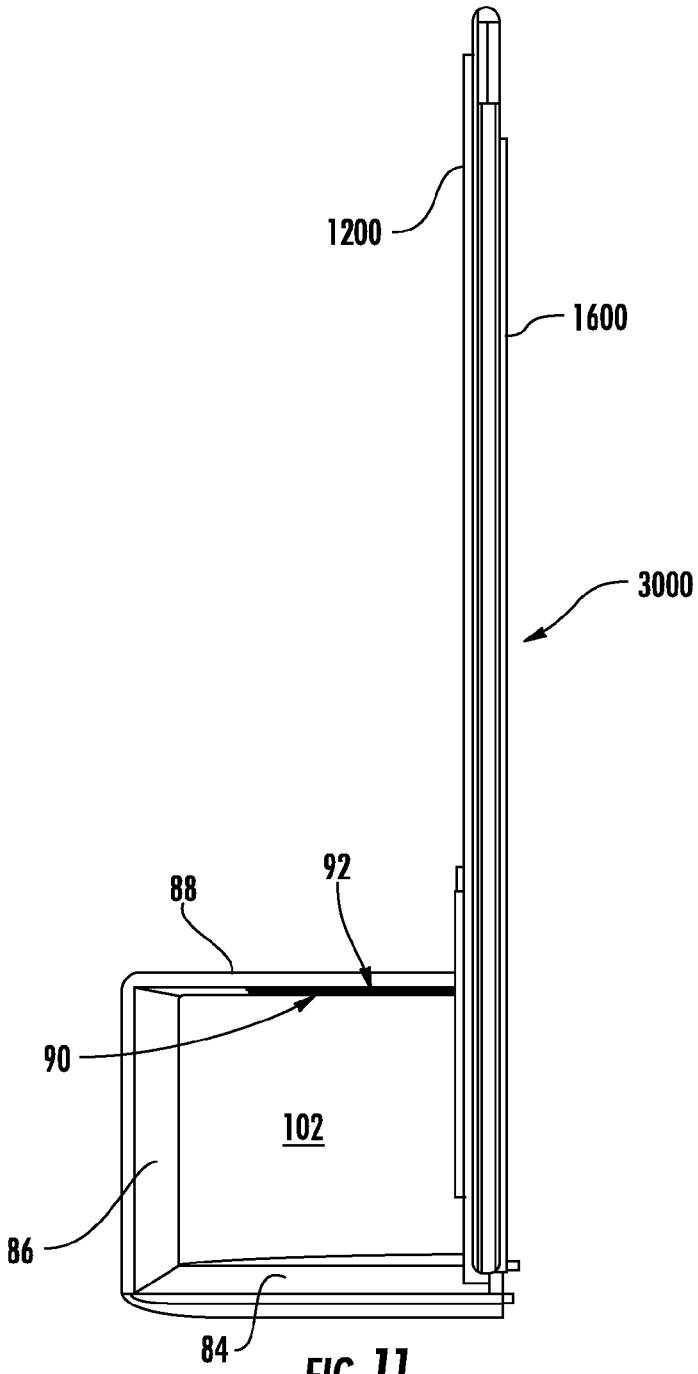
FIG. 11 is a side elevation of the collapsible seat of FIGS. 9 and 10.

Turning now to FIGS. 9, 10 and 11, the third portion 88 has two apertures or cut-outs 90 & 92 adapted to in use receive one or more objects (not shown). Flaps 96 & 98 are adhered onto the underside of the seat panel 1200 to create the apertures or cut-outs 90 & 92. Conveniently, the apertures or cut-outs 90 & 92 can take different shapes to suit the one or more objects to be received therein.

When the collapsible seat 3000 is in a collapsed position with the back and support panels 1400 & 1600 (see FIG. 11) on one side abutting the seat panel 1200, folding of the first portion 84 towards the support panel 1600 results in a cavity 102 defined by the first, second and third portions 84, 86 & 88 bulging from an opposite side of the seal panel 1200.

The cavity 102 is adapted to hold the one or more objects (not shown) received by the third portion 88. In the present example, the apertures or cut-outs 90 & 92 are shaped such that they are complementary to the contour of a beverage bottle or a glass. The objects however may include containers of different shapes, books, towels, DVDs, cameras and toys. Also, the apertures or cut-outs may be provided such that they are in communication with each other to accommodate an object of a unique or irregular shape.

As shown in FIGS. 8 and 9, a tab 104 as part of the seat panel 1200 is accommodated within the cut-out 8400. When the collapsible seat 3000 is in a collapsed position, the tab 104 is pushed to penetrate through and engage corresponding cut-outs (not shown) of the back and support panels 1400 & 1600 so as to bind the seal panel 1200 securely to the back and support panels 1400 & 1600 to facilitate easy transportation of the collapsible seat 3000.

In the present embodiment, in addition to those mentioned above, the method of constructing the collapsible seat 3000 includes yet further steps of:

(k) collapsing the collapsible seat 3000 such that the back and support panels 1400 & 1600 are on one side and abutting the seat panel 1200; and (l) folding the first portion 84 towards the support panel 1600 resulting in the cavity 102 defined by the first, second and third portions 84, 86 & 88, bulging from an opposite side of the seat panel 1200.

Subsequently, the one or more objects (not shown) may be received by the third portion 88 and held in place within the cavity 102.

Optionally, the method includes a further step of (m) pushing the tab 104 through the cut-outs (for handles) provided in the back and support panels 1400 & 1600 so as to bind the seat panel to the back and support panels 1400 & 1600.

Figure 12:
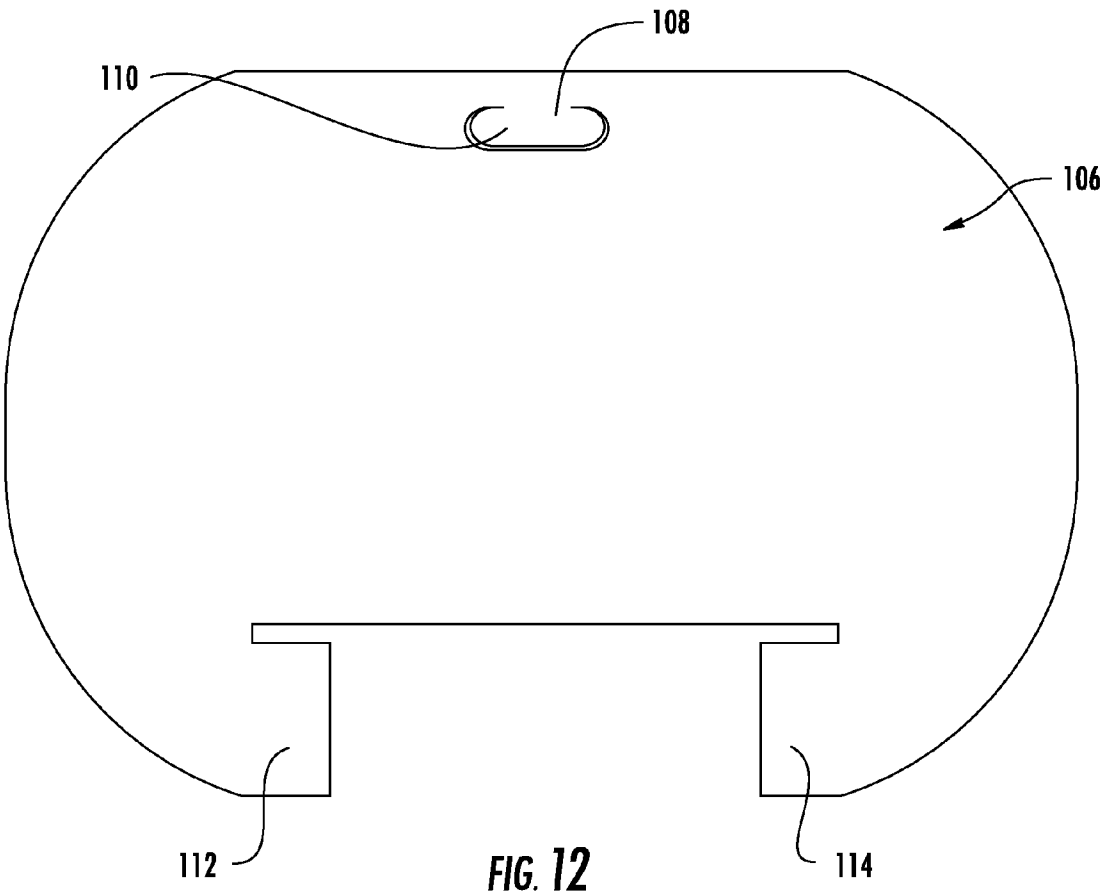
FIG. 12 is a front view of a sheet adapted to be mounted onto the collapsible seat for advertising purposes.

Referring now to FIG. 12, a sheet 106 conforming to the shape of the seat panel 3000 is shown. The sheet 106 includes a handle 108 having a tab 110 which corresponds to the tab 104, and two tags 112 & 114. When in use, the sheet 106 is mounted onto the seat panel 1200 by engaging the tab 110 with the tab 104, and tucking the tabs 112 & 114 into the opposite ends 106 & 108 of the cavity 102 respectively. It is anticipated that the tags 112 & 114 may take different shapes or forms to enable easy insertion into and withdrawal from the cavity 102. The sheet 106 is intended to serve as an advertising material on which any brand, logo, promotional slogan or picture may be printed. As it is detachable from the collapsible seat 3000, the sheet 106 offers the advantage of being replaceable frequently to run different marketing campaigns.

Now that a preferred embodiment of the present invention has been described in some detail, it will be apparent to those skilled in the art that the blank and collapsible seat have at least the following advantages over the admitted prior art:

(1) the blank can be easily and effectively manipulated to construct a collapsible seat with a considerably low degree of skill and dexterity;

(2) the collapsible seat in the erected state has an appreciable level of sustainability and integrity;

(3) the collapsible seat is easy to collapse and carry around;

(4) the design of the back of the collapsible seat provides a good support to the back of a human body and allows a comfortable seating position;

(5) the reinforcement panel allows convenient transportation of objects such as wine bottles or books; and (6) the sheet permits swift and easy replacement of advertising materials to be attached to the same collapsible seat.

Those skilled in the art will appreciate that the invention described herein is susceptible to variations and modifications other than those specifically described. For example, the fold lines may have different lengths from those shown in the accompanying drawings. Also, the joining means may engage or connect to the corresponding panels by way of a different mechanism such as interlocking tabs. Furthermore, the crease may be located differently so as to conform to the contour of the back of a child. Finally, the width of the base of the webs (refer to FIG. 6) denoted by B-B may be varied to enhance the integrity and sustainability of the seats of the present invention. All such variations and modifications are to be considered within the scope of the present invention, the nature of which is to be determined from the foregoing description.

It is to be understood that any acknowledgment of prior art in this specification is not an admission that this prior art forms part of the common general knowledge in the relevant art.

INDUSTRIAL APPLICABILITY

The invention has industrial applicability in that it provides a seat which can give the benefits of having integrity yet being easy to collapse for transportation, being capable of carrying foreign objects, and facilitating advertising to take place with optionally replaceable advertising or promotional materials.

The invention claimed is:

1. A collapsible seat suitable for forming from a sheet material, the seat including:

a seat panel;

a back panel linked to the seat panel along a first fold line;

a support panel linked to one side of the back panel via a first web defined by second and third fold lines, and adapted to be linked to another side of the back panel via a second web partially defined by a fourth fold line;

a reinforcement panel having one end linked to the support panel along a fifth fold line and an opposite end, the reinforcement panel adapted to be positioned generally horizontally and under the seat panel in use;

each of the first and second webs has an extension linking the respective webs with at least part of the reinforcement panel;

wherein in use the back panel is adapted to be positioned generally vertically, the seat panel is adapted to be positioned generally horizontally and on one side of the back panel and the support panel is adapted to be positioned generally vertically and on the other side of the back panel.

2. The collapsible seat of claim 1, wherein each of the seat, back and support panels includes a cut-out, the cut-outs being adapted to correspond to one another when the seat is collapsed to form a carry handle.

3. The collapsible seat of claim 1, wherein each extension has a further fold line dividing the extension into two halves foldable towards one another.

4. The collapsible seat of claim 1, wherein the support panel includes a crease adapted when in use to conform to a contour of a back of a human body.

5. The collapsible seat of claim 4, wherein the crease is curved extending from one side of the support panel to another.

6. The collapsible seat of claim 4, wherein the crease when in use is adapted to enable the support panel to optimise its coverage of and supporting capability to the back of the human body via the back panel.

7. The collapsible seat of claim 1, wherein the first web further includes a sixth fold line dividing the first web into two portions foldable towards each other.

8. The collapsible seat of claim 7, wherein the second web is linked to a first joining means along a seventh fold line, the first joining means being adapted to be in registry with at least part of the back panel in use.

9. The collapsible seat of claim 8, wherein the second web includes an eighth fold line dividing the second web into two portions foldable towards each other.

10. The collapsible seat of claim 9, wherein the reinforcement panel is linked to a second joining means along a ninth fold line, the second joining means being adapted to be in registry with the seat panel in use.

11. The collapsible seat of claim 10, wherein the second joining means or the reinforcement panel includes a tenth fold line, so positioned that the distance between the ninth and tenth fold lines corresponds to a thickness of the sheet material thereby enhancing the foldability of the seat panel when the second joining means is adhered thereon.

12. The collapsible seat of claim 11, wherein the reinforcement panel includes an eleventh fold line dividing the reinforcement panel into two portions foldable towards each other, the eleventh fold line being so positioned as to correspond to the sixth and the eighth fold lines.

13. The collapsible seat of claim 12, wherein the reinforcement panel includes twelfth and thirteenth fold lines intermediate the fifth fold line and the opposite end, the twelfth and thirteenth fold lines being located such that the reinforcement panel is divided into first, second and third portions, the first and third portions being substantially identical in size.

14. The collapsible seat of claim 13, wherein the third portion has one or more apertures or cut-outs adapted to in use receive one or more objects.

15. The collapsible seat of claim 13, wherein when the collapsible seat is in a collapsed position with the back and support panels on one side and abutting the seat panel, folding of the first portion towards the support panel results in a cavity defined by the first, second and third portions, bulging from an opposite side of the seat panel.

16. The collapsible seat of claim 15, wherein the cavity is adapted to hold one or more objects received by the third portion.

17. A blank for forming a collapsible seat, the blank including:

a seat panel; a back panel linked to the seat panel along a first fold line;

a support panel linked to the back panel along a second fold line;

the support panel linked to one side of the back panel via a first web having a third fold line, and adapted to be linked to an opposing side of the back panel via a second web having a fourth fold line;

a reinforcement panel having one end linked to the support panel along a fifth fold line and an opposite end, the reinforcement panel adapted to be positioned generally horizontally and under the seat panel in use;

wherein each of the first and second webs has an extension linking the respective webs with at least part of the reinforcement panel.

18. A method of constructing a collapsible seat from a blank of claim 17, wherein:

the first web includes a sixth fold line dividing the first web into two portions foldable towards each other;

the second web is linked to a first joining means along a seventh fold line, the first joining means being adapted to be in registry with at least part of the back panel in use;

the second web includes an eighth fold line dividing the second web into two portions foldable towards each other; and the reinforcement panel is linked to a second joining means along a ninth fold line, the second joining means being adapted to be in registry with the seat panel in use;

and wherein the method comprises:

(a) positioning the back panel generally vertically;

(b) folding the seat panel away from the back panel until the seat panel is generally horizontal and on one side of the back panel;

(c) folding the support panel towards the back panel until the support panel is superimposed on the other side of the back panel;

(d) folding the first and second joining means towards the back panel;

(e) connecting the first and second joining means to the back panel; and (f) pushing the first and second webs towards each other by applying pressure on the fold lines thereon;

(g) folding the reinforcement panel towards an underside of the seat panel;

(h) connecting the second joining means to the underside of the seat panel; and (i) pushing the extension of each of the first and second webs towards an interior of the seat by applying pressure on a respective fold line dividing the extension of each of the first and second webs into two halves foldable towards one another.

19. The method of claim 18, wherein:

the second joining means or the reinforcement panel includes a tenth fold line, so positioned that the distance between the ninth and tenth fold lines corresponds to a thickness of the sheet material thereby enhancing the foldability of the seat panel when the second joining means is adhered thereon; and the reinforcement panel includes an eleventh fold line dividing the reinforcement panel into two portions foldable towards each other, the eleventh fold line being so positioned as to correspond to the sixth and the eighth fold lines;

and wherein the method comprises:

closing a gap between the reinforcement panel, and the first and second webs, by applying pressure on the eleventh fold line.

20. The method of claim 18, which includes the further steps of:

collapsing the collapsible seat such that the back and support panels are on one side and abutting the seat panel; and folding the first portion towards the support panel resulting in a cavity defined by the first portion, the second portion and a third portion, bulging from an opposite side of the seat panel.

21. The method of claim 20 which includes a step of detachably mounting a sheet onto the collapsible seat, wherein each of the seat, back and support panels includes a cut-out, the cut-outs being adapted to correspond to one another when the seat is collapsed to form a carry handle, wherein when the collapsible seat is in a collapsed position with the back and support panels on one side and abutting the seat panel, the sheet having a tab and two tags adapted to engage the carry handle and the cavity of the collapsible seat respectively.

* * * * *